United States Patent [19]

Ochi

[11] 4,142,192

[45] Feb. 27, 1979

[54] ELECTROGRAPHIC PROCESS AND APPARATUS WITH RECORDING AFTER TONING

[75] Inventor: Hiroshi Ochi, Kodaira, Japan

[73] Assignee: Nippon Telegraph and Telephone Public Corporation, Tokyo, Japan

[21] Appl. No.: 816,059

[22] Filed: Jul. 15, 1977

[30] Foreign Application Priority Data

Jul. 16, 1976 [JP] Japan .....51-84566

[51] Int. Cl.[2] ..... G03G 15/06

[52] U.S. Cl. ..... 346/153; 346/160

[58] Field of Search ..... 346/153, 154, 159, 160

[56] References Cited

U.S. PATENT DOCUMENTS

| | | | |
|---|---|---|---|
| 2,753,796 | 7/1956 | Wood | 346/153 |
| 3,182,591 | 5/1965 | Carlson | 346/153 |
| 3,308,473 | 3/1967 | Sawazaki | 346/153 |
| 3,551,146 | 12/1970 | Gundlach | 346/153 |
| 3,714,665 | 1/1973 | Mutschler | 346/153 |
| 3,743,411 | 7/1973 | Krekow | 346/153 |
| 3,778,841 | 12/1973 | Gundlach | 346/153 |
| 3,879,737 | 4/1975 | Lunde | 346/153 |

*Primary Examiner*—Jay P. Lucas

*Attorney, Agent, or Firm*—Townsend and Townsend

[57] ABSTRACT

Recording medium is disposed in a recording region defined between a pair of electrodes impressed with a signal voltage. Electroconductive toner is supplied between one surface of the recording medium and one of the electrodes and electroconductive material in the form of a powder or liquid is supplied between the other surface of the recording medium and the other electrode. By selectively applying the signal voltage the toner, recording medium and the electroconductive material are charged to selectively deposit the toner and the electroconductive material on the surfaces of the recording medium thus forming a toner image. After removing surplus toner, the toner image is fixed to obtain a permanent record.

15 Claims, 11 Drawing Figures

ELECTROGRAPHIC PROCESS AND APPARATUS WITH RECORDING AFTER TONING

BACKGROUND OF THE INVENTION

This invention relates to an electrographic recording process and apparatus, and more particularly a novel electrographic recording process and apparatus capable of electrostatically recording a picture on plain paper with a relatively low voltage.

With widespread use of facsimile equipment in recent years, it has been highly desired to provide facsimile equipment of small and economical type. Furthermore, it is also desirable to use inexpensive plain paper for the purpose of decreasing the operating cost. The term "plain paper" is used herein to mean ordinary inexpensive paper usually used in business. However, if it is desired to improve the quality of the reproduced facsimile picture the paper may be properly treated. Among the methods of using inexpensive plain recording paper are included electrophotography utilizing transfer printing of toner images and an ink jet recording apparatus. In electrophotography, the apparatus is complicated and bulky because it requires development, transfer printing and cleaning steps. On other hand, in the ink jet devices it is difficult to obtain flat bed scanning because of the mechanical scanning system and hence the recording speed and reliability are low.

As a method of obtaining a stable and high quality record by using relatively simple apparatus, an electrostatic recording process has been proposed which has been applied to facsimile equipments. However, according to the prior art electrostatic recording method an electrostatic latent image is formed by establishing an electric discharge through a microgap between an electrode and the recording paper so that it is necessary to use a recording voltage higher than 500 volts.

Furthermore, as the electrostatic latent image formed on recording paper is developed with a toner it is necessary to preserve the charge deposited at the time of forming the latent image until it is developed so that it is necessary to use special recording paper coated with a dielectric layer, thereby increasing the cost of recording.

Another electrographic recording apparatus in which a toner image is directly formed on a recording medium such as plain paper is disclosed in Kotz et al U.S. Pat. No. 3,816,840 entitled, "Electrographic Recording Process and Apparatus Using Conductive Toner subject to a Capacitive Force".

SUMMARY OF THE INVENTION

It is an object of this invention to provide a novel electrographic recording process and apparatus capable of forming visible images directly on plain paper at a relatively low recording voltage.

Another object of this invention is to provide an improved electrographic recording apparatus provided with toner supply means that can efficiently supply the toner to the recording medium and recover the toner therefrom.

According to one aspect of this invention there is provided an electrographic apparatus comprising a pair of opposed electrodes which are mutually spaced to define a recording region therebetween, means for applying a signal voltage across the pair of electrodes, means for feeding a recording medium through the recording region, toner supply means for continuously supplying an electroconductive toner between one of the electrodes and one surface of the recording medium, means for continuously supplying electroconductive material between the other electrode and the other surface of the recording medium, means for removing surplus toner and electroconductive material from the surfaces of the recording medium after it has passed through the recording region, thereby forming a toner image, and means for fixing the toner image.

According to another aspect of this invention there is provided an electrographic printing apparatus comprising a recording electrode drum including a first rotary insulating cylinder and a plurality of character electrodes embedded in the periphery of the insulating cylinder, a stationary magnet roller concentrically contained in the recording electrode drum, a selection electrode drum oppositely disposed with respect to the recording electrode drum to define a recording region therebetween, said selection electrode drum including a second rotary insulating cylinder and a plurality of selection electrodes embedded in the periphery of the second rotary insulating cylinder, a second stationary magnet roller concentrically contained in the selection electrode drum, means for feeding a recording medium through the recording region, means for supplying electroconductive and magnetic toner between the recording electrode drum and one surface of the recording medium, means for supplying electroconductive and magnetic material between the selection electrode drum and the other surface of the recording medium, and means for supplying an operating voltage across the character electrode and the selection electrode.

According to a further aspect of this invention, there is provided an electrographic recording process comprising the steps of passing recording medium through a recording region between a pair of opposing electrodes one of which is transparent and provided with a photoconductive layer on one surface, supplying an electroconductive toner between one surface of the recording medium and the transparent electrode, supplying electroconductive material between the other surface of said recording medium and the other electrode, applying a DC voltage across the pair of electrodes, projecting a light image on the photoconductive layer through the transparent electrode to decrease the internal resistance of the photoconductive layer in accordance with the light image thereby selectively depositing charged toner and charged electroconductive material on the opposite surfaces of said recording medium, and removing surplus toner from said one surface of said recording medium thereby forming a toner image.

According to a further aspect of this invention there is provided an electrographic recording process comprising the steps of passing recording medium through a recording region between a pair of opposing electrodes, supplying an electroconductive and magnetic toner between one surface of the recording medium and one of the electrodes, supplying electroconductive liquid between the other surface of said recording medium and the other electrode, selectively applying a signal voltage across the toner, the recording medium and the electroconductive liquid through the electrodes for selectively depositing charged toner and charged electroconductive liquid on the opposite surfaces of the recording medium, and removing surplus toner from the one surface of the recording medium thereby forming a toner image.

BRIEF DESCRIPTION OF THE DRAWINGS

Further objects and advantages of the invention can be more fully understood from the following detailed description taken in conjunction with the accompanying drawings in which.

DESCRIPTION OF THE PREFERRED EMBODIMENTS

Figure 1:
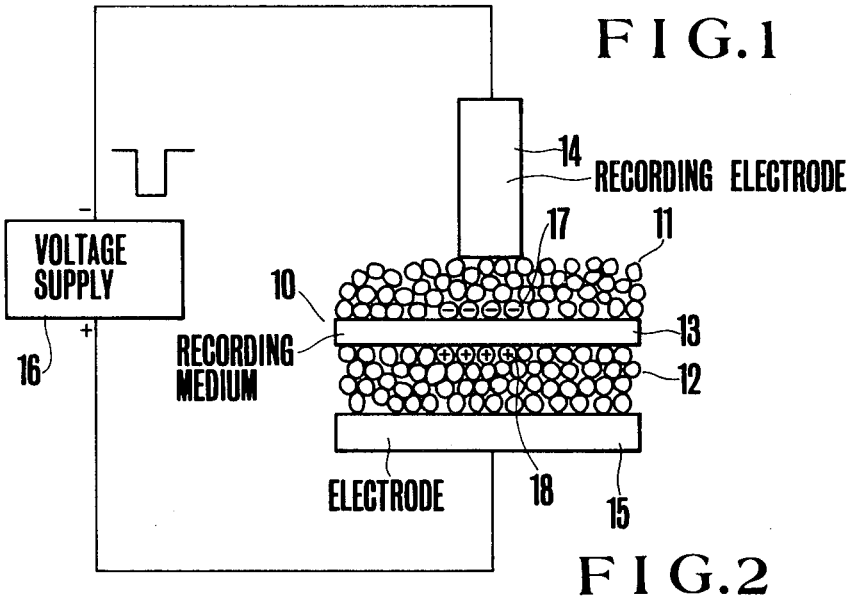
FIG. 1 is a diagrammatic representation showing the principle of the invention.

As shown in FIG. 1, a recording electrode 14 and a counter electrode 15 which are disposed in a spaced opposing relationship are connected to the negative and positive poles respectively of a voltage supply 16 to form a recording region 10 therebetween. The voltage supply 16 is used to selectively apply a voltage across the electrodes and may comprise a voltage generator adapted to generate a rectangular wave as shown corresponding to a picture to be recorded or a combination of a direct current source and a switch which is ON-OFF controlled corresponding to a picture to be recorded. A recording medium 13 in the form of a sheet which may be payed out from a roll is fed through the recording region. In this invention, plain paper having a thickness of several ten microns may be used as the recording medium 13. Thin layers of an electroconductive toner 11 and an electroconductive powder 12 are supplied into the gaps between the recording medium 13 and the electrodes 14 and 15 from suitable supply devices, not shown. The electroconductive toner 11 comprises a coloured powder having a diameter of several to several ten microns. For example, such toner is formed by compounding magnetic powder (magnetite, ferrite, etc.) with an epoxy resin, pulverizing the mixture and then covering with carbon black. Electroconductive powder 12 comprises a powder of an electroconductor and also has a diameter of several to a few hundred microns (about 300 microns). This powder may be or may not be coloured. Accordingly, the electroconductive toner 11 may be used as the electroconductive powder 12.

Although the electroconductive toner 11 and the electroconductive powder 12 may be an electric conductor, in the embodiments of this invention described below it is advantageous to use material having electrically conductive and magnetic (magnetically attractive) characteristics for the purpose of making easy supply of the material to the surfaces of the recording medium.

The principle of the apparatus shown in FIG. 1 is as follows. An operating voltage is impressed across the opposing electrodes 14 and 15 from voltage supply 16. Then current flows through the layers of the electroconductive toner 11 and the electroconductive powder 12 to charge the electrostatic capacitance of the recording medium 13. By this charging current, the toner particles 17 and the electroconductive powder particles 18 adjacent the recording medium 13 are charged. In the case shown in FIG. 1, the electroconductive toner particles 17 are charged negatively, whereas the electroconductive powder 18 are charged positively.

These toner particles 17 and electroconductive powder particles 18 which are charged with opposite polarities attract each other by Coulomb force so that after most of the toner 11 and the powder 12 are removed from the surfaces of the recording medium, some of them remain on the surfaces of the recording medium.

When the electroconductive toner 11 is coloured but the powder 12 is not coloured or coloured to the same colour as that of the recording medium, it is possible to form a visible image of the toner 11 on the recording medium by selectively applying a voltage across the electrodes from source 16 in accordance with picture information. Most of the toner 11 and electroconductive powder 12 can be removed from the surfaces of the recording medium by applying supersonic vibration to the recording medium so as to remove the powders other than those attracted by the electrostatic force or by blowing compressed air against the surfaces of the recording medium. In this manner, according to this method, once an electrostatic field is applied across the layers of the toner and the electroconductive powder, the toner is charged so that it is not necessary to use high voltage as in a method wherein charging is made by electric discharge in air. Furthermore, by the action of the electroconductive powder 12, the magnitude of the voltage applied for recording is reduced, and it is possible to form a toner image directly on the recording medium without forming a latent image thereon.

Figure 2:
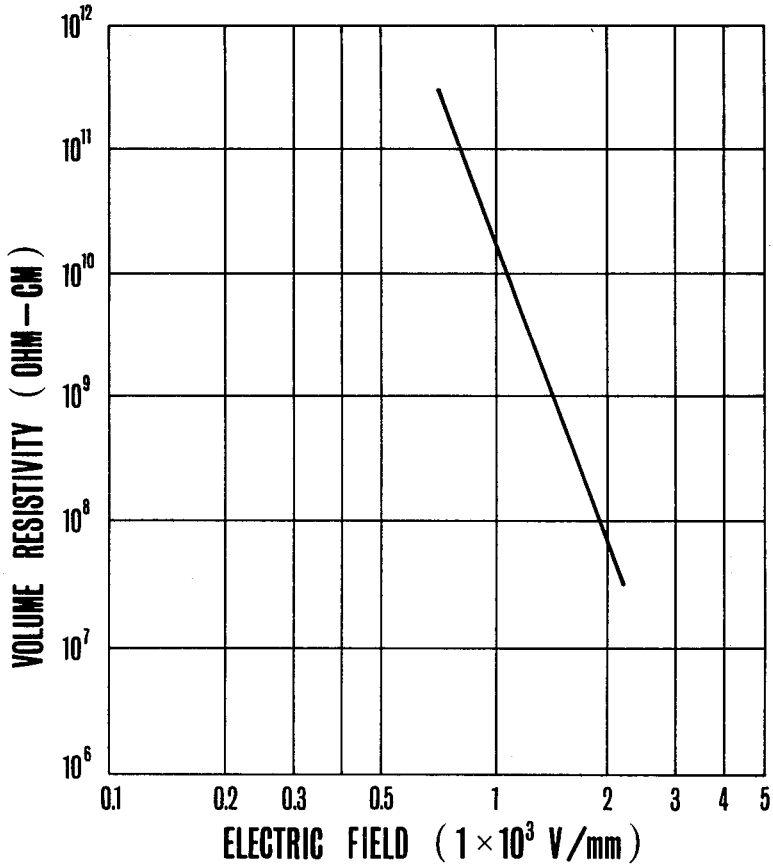
FIG. 2 is a graph showing the electric field-volume resistivity characteristic of the electroconductive toner utilized in this invention.

As shown in FIG. 2, the volume resistivity of the electroconductive toner varies inversely with the electric field. Accordingly, the charge applied to the toner particles 17 and the electric conductive powder particles 18 by a pulse shaped signal voltage impressed across the recording electrode 14 and the counter electrode 15 tends to gradually decay after termination of the signal voltage, but owing to the fact that the resistivity of the toner layer increases as the electric field decreases, the charges of the toner particles 17 and the electroconductive powder particles 18 persist with a slight decay. Furthermore, as the toner particles 17 and powder particles 18 have a certain degree of resistivity, the current that flows in the direction parallel to the surface of the recording medium is small so that degradation in the resolution is negligibly small.

In the foregoing description it was assumed that the electroconductive powder 12 is colourless or has the same colour as the recording medium, but where the powder 12 is coloured, for example where the toner 11 and the electroconductive powder 12 are made of the same material, when fixing the powder that forms a toner image, the fixing of the material acting as the electroconductive powder particles 18 is made less than that of the material that acts as the toner so as to remove the material acting as the electroconductive powder particles 18. Alternatively, the material acting as the electroconductive powder particles 18 may be preserved on the recording medium so as to transfer print the toner image onto another recording medium.

Figure 3:
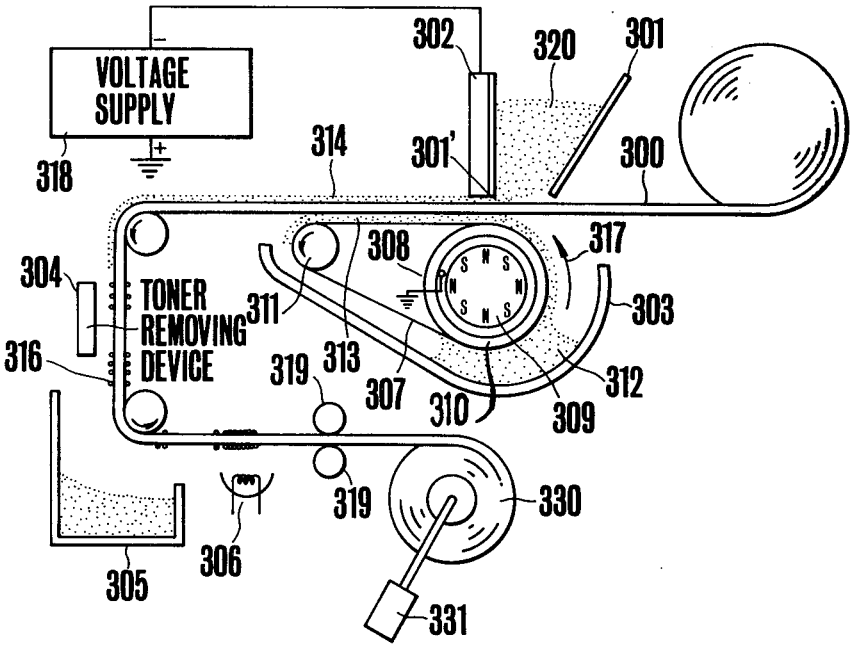
FIG. 3 is a side view showing one embodiment of an electrographic recording apparatus embodying the invention.

FIG. 3 illustrates one example of the electrographic recording apparatus of this invention constructed according to the principle shown in FIG. 1. The apparatus shown in FIG. 3 comprises a recording medium 300 payed out from a roll, a toner container 301, a recording electrode 302 disposed above the recording medium, a container 303 disposed beneath the recording medium 300 and containing an electroconductive and magnetic powder 312, a powder removing device 304 shown as a ultrasonic vibrating element, a container 305 for collecting recovered toner, and a fixing device 306 shown as an electric heater. In the container 303 of the electroconductive and magnetic powder are disposed an electroconductive belt 307 and a magnetic brush 308 which comprises a magnet roller 309 supported by the stationary frame of the apparatus, not shown, and a grounded electroconductive rotary sleeve 310 concentric with the magnet roller 309. The belt 307 is wrapped about the rotary sleeve 310 and a guide roller 311. The rotary sleeve 310 is driven by a driving device, not shown, in the direction of an arrow 317 for supplying the electroconductive and magnetic powder 312 to a gap between the belt 307 and the recording medium 300 thereby forming a layer 313 of the electroconductive and magnetic powder 312. A powder of magnetic material such as iron is incorporated into the electroconductive powder for magnetically attracting the powder to the surface of the rotary sleeve 310 by the magnetic field of the magnet roller 309. Advantageously, the electroconductive belt 307 may comprise a mixture of a silicone resin and a silver powder such as that designated by the mark CHO Seal and sold by Chomerics, Inc. of Woburn, Massachusetts. The apparatus for conveying the magnetic powder by relatively moving the rotary sleeve 310 and the magnet roller 309 may be of the type disclosed in the aforementioned U.S. Pat. No. 3,879,737 to Lunde, et al entitled "Integrated Electrographic Recording and Developing Stylus Assembly." A voltage supply 318 may be a pulse generator or a combination of a DC source and a periodically operated switch. The negative pole of the source 318 is connected to the recording electrode 302 which is mounted on the toner container 301 through a suitable insulator not shown, while the positive pole is grounded. The rotary sleeve 310 is grounded by a brush which is in sliding contact therewith. The rotary sleeve 310, and the electroconductive belt 307 constitute a counter electrode opposing the recording electrode 302.

In this embodiment, the recording medium 300 payed out from a roll is passed through the recording region by a take up roller 330 driven by an electric motor 331 via a pair of pinch rollers 319.

The embodiment shown in FIG. 3 operates as follows. The electroconductive toner 320 in the container 301 passes through a gap 301' of an order of 0.1 mm to form a thin layer 314 on the recording medium 300. The recording electrode 302 is in contact with the toner layer 314 for applying the source voltage. As a consequence, the toner layer 314 and the layer 313 of the electroconductorive and magnetic powder are charged by the signal voltage thereby forming a toner image. Thereafer, surplus toner is removed by the ultrasonic vibrating element 304, and then the toner image 316 is fixed by the fixing device 306 to obtain a permanent record.

Figure 4:
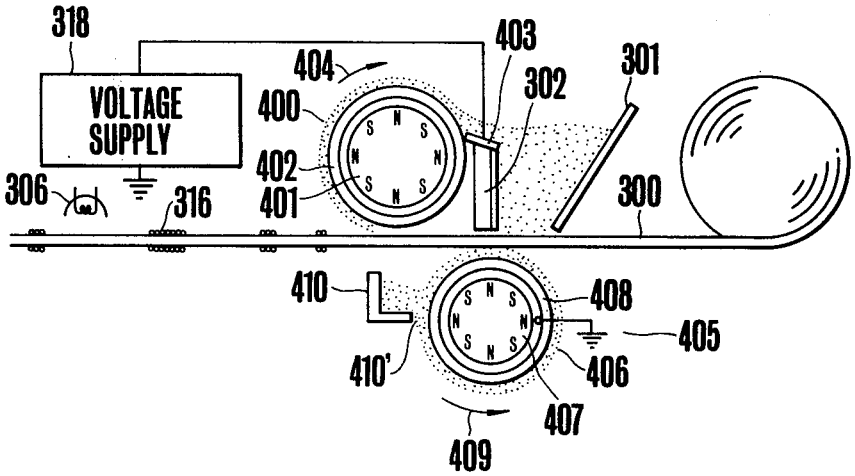
FIG. 4 is a side view showing a modified embodiment of the invention.

FIG. 4 illustrates another embodiment of this invention in which the same elements as shown in FIG. 3 are designated by the same reference numerals. In this embodiment a toner recovering device 400 is disposed adjacent the recording electrode 302. The toner recovery device 400 has a construction similar to that of the magnetic brush 308, that is, it comprises a stationary magnet roller 401 and a rotary sleeve 402 concentric therewith. A guide member 403 inclining towards the toner container 301 is mounted above the recording electrode 302. The portion of the guide member 403 in contact with the rotary sleeve 402 is made of pliable material such as felt. Consequently, the electroconductive and toner which has passed through the recording region and been attracted by the recording medium by a relatively weak attractive force is picked up by the magnet roller 401 and then conveyed by the rotary sleeve 402 rotated by a drive (not shown) in the circumferential direction of arrow 404 to the guide member 403, thus being recovered in the toner container 301. In this manner, the toner is recovered for reuse. Since the rotary sleeve 402 of the toner recovering device 400 does not constitute the recording electrode it is not necessary that it be electrically conductive. A magnetic brush 405 disposed beneath the recording medium 300 comprises a stationary magnet roller 407 and a rotary sleeve 408 rotated in the direction of arrow 409 for conveying the electroconductive and magnetic powder 406 to the lower surface of the recording medium 300. A container 410 for the electroconductive and magnetic powder 406 is mounted close to the periphery of the sleeve 408 with a gap 410' therebetween. Alternatively, the sleeve 408 may be fixed and the magnet roller 407 rotated in the direction opposite to the direction of arrow 409, to convey the powder in the direction of arrow 409. The construction and operation of the other elements are identical to those shown in FIG. 3.

In these systems shown in FIGS. 3 and 4, a two-dimensional picture can be formed by using a single needle as the electrode 302, which is moved at a high speed in a direction perpendicular to the direction of feed of the recording medium. Another method to form a two-dimensional picture is to use a multi-stylus as the electrode 302, in which a series of recording electrodes are provided and a signal voltage is applied sequentially to the electrodes by means of electronic switching.

Figure 5:
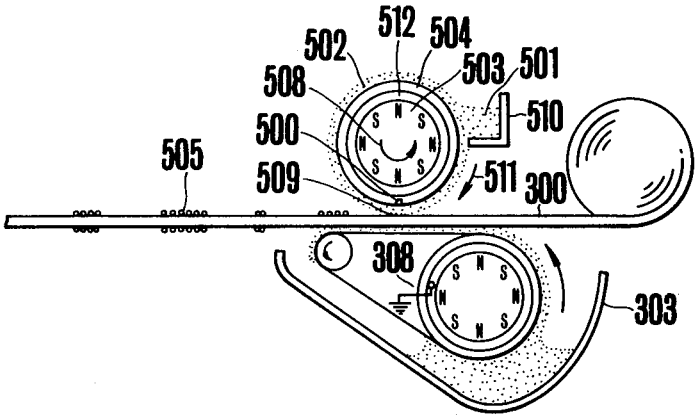
FIG. 5 is a side view showing still another embodiment of the invention.
Figure 7:
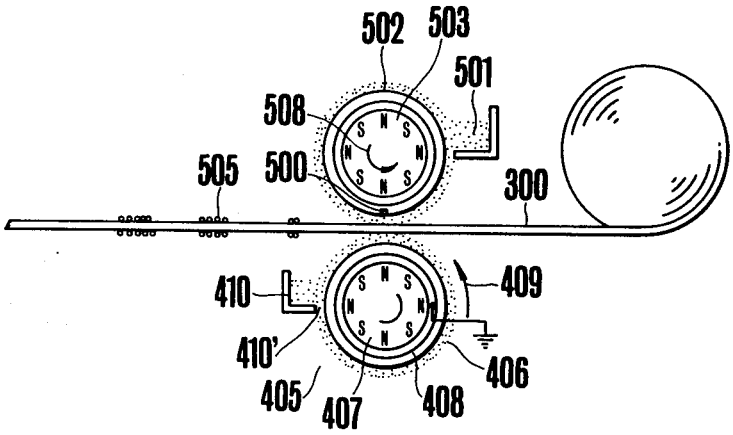
FIGS. 7 and 8 are side views showing still further embodiments of the invention.
Figure 8:
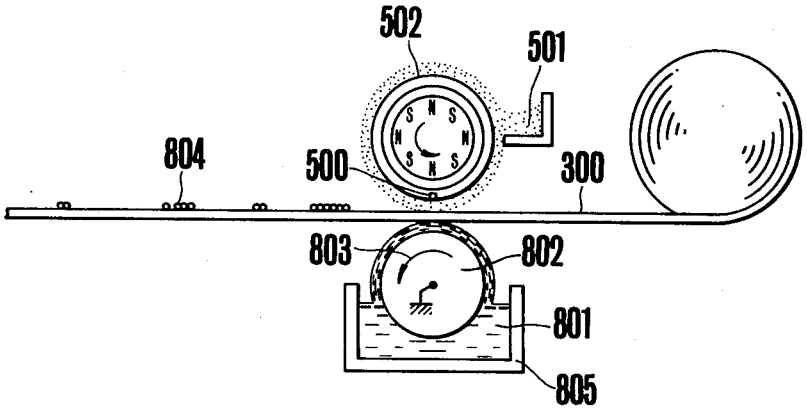

FIGS. 5, 7 and 8 show still further embodiments of this invention. To simplify the description, elements shown in these drawings and corresponding to those in the previous embodiments are designated by the same reference characters.

Figure 6:
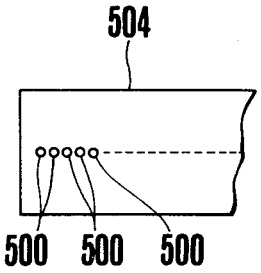
FIG. 6 is a plan view showing the recording electrodes utilized in the apparatus shown in FIG. 5.

The embodiment shown in FIG. 5 comprises a magnetic brush 502 disposed above the recording medium 300 and including a stationary hollow sleeve 504 with inner and outer surfaces and a magnet roller 503 rotated in the sleeve 504 in the direction of arrow 508 for supplying the electroconductive and magnetic toner 501 contained in a container 510 to a recording region 509 in the direction indicated by arrow 511. As shown by a developed view shown in FIG. 6 a series of recording electrodes 500 are disposed on the rear of the outer surface of sleeve 504 in the axial direction thereof with respective electrodes electrically insulated. Operating voltage is applied sequentially to the electrodes for forming a two-dimensional toner image 505 across the width of the recording medium. Such arrangement of electrodes is disclosed in U.S. Pat. No. 3,879,737, for example. As can be clearly noted by the foregoing description, the magnet brush 502 not only supplies the toner 501 to the recording region 509 but also removes surplus toner. The lead wires (not shown) to respective electrodes are connected to a drive circuit, not shown, through a gap 512 between the roller 503 and sleeve 504.

In the embodiment shown in FIG. 7 magnetic brushes 502 and 405 are disposed on the opposite sides of the recording medium 300 for respectively supplying the electroconductive magnetic toner 501 and the electroconductive magnetic powder 406. In this embodiment, as has been described with reference to FIGS. 5 and 6, the toner 501 is supplied onto the recording medium by rotating the magnet roller 503 of the magnetic brush 502, and is charged by the voltage impressed upon the electrodes 500. The magnetic brush 405 conveys the electroconductive magnetic powder 406 to the lower side of the recording medium by rotating sleeve 408 or magnet roller 407 as in the case of FIG. 4.

FIG. 8 shows still another embodiment of this invention in which electroconductive liquid is used in lieu of an electroconductive powder. The electroconductive liquid 801 is contained in a container 805 and conveyed to the lower surface of the recording medium 300 by a grounded electroconductive roller 802 which is rotated in the direction of an arrow 803. By applying a signal voltage across the recording electrodes 500 and the roller 802 a toner image 804 is formed on the recording medium 300. In this embodiment, the toner is attracted by the electrostatic attractive force between the charge of the toner and the charge on the recording medium formed thereon through the electroconductive liquid. The electroconductive liquid may be water or one of the alcohols. A liquid impervious film may be applied to the lower surface of the recording medium which comes into contact with the liquid. A polyester film, for example, may be used as the recording medium.

Figure 9:
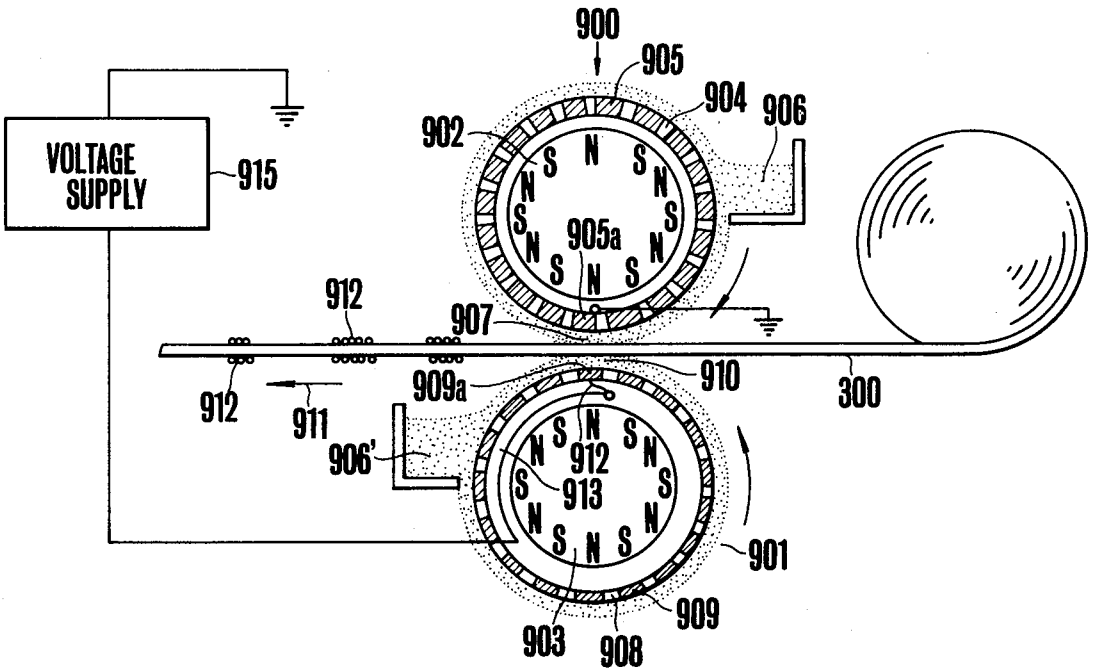
FIG. 9 is a side view of apparatus in which the invention is applied to a printer.

FIG. 9 shows an application of this invention to a printer, which comprises a recording electrode drum 900, a selection electrode drum 901, and stationary magnet rollers 902 and 903. The recording electrode drum 900 is surrounded by a rotary insulating sleeve 904 in which a plurality of character electrodes 905 are embedded. The character electrodes 905 take the form of letters or symbols which are grounded. Like the recording electrode drum 900, the selection electrode drum 901 comprises an insulating sleeve 908 in which a plurality of selection electrodes 909 are embedded. The recording electrode drum 900 and the selection electrode drum 901 are rotated at the same peripheral speeds about magnet rollers 902 and 903, each comprising alternately disposed N and S magnets to supply electroconductive and magnetic toners 906 and 906' to recording regions 907 and 910 on the opposite surfaces of the recording medium 300.

The embodiment shown in FIG. 9 operates as follows.

An operating voltage is impressed across a character electrode **905*a* and a selection electrode 909*a* which are oppositely disposed in the recording region thereby selectively charging the electroconductive and magnetic toner 906 in the recording region in the form of the charactor electrode 905*a* by the principle described in connection with FIG. 1. As the recording medium 300 is advanced in the direction of arrow 911 to the outside of the recording region, the surplus toner is recovered by the recording electrode drum 900 and the selection electrode drum 901 to form toner images 912** which are then fixed by a fixing device to obtain permanent records.

Figure 10:
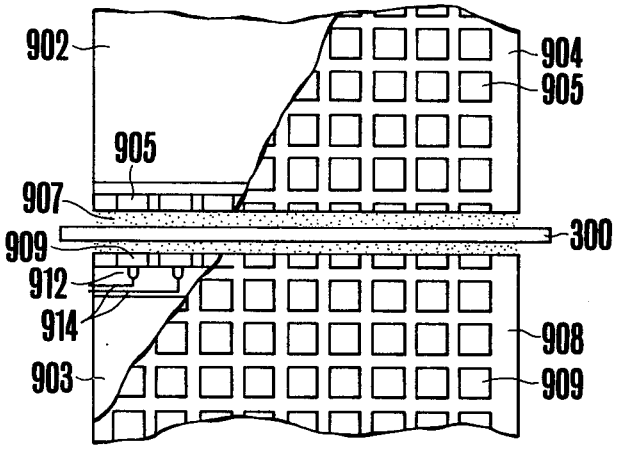
FIG. 10 is a plan view showing the arrangement of the electrodes utilized in the apparatus shown in FIG. 9

The character electrodes and the selective electrodes are arranged at an equal spacing on the surfaces of the recording electrode drum 900 and the character selection drum 901 as shown in FIG. 10. When a character electrode to be printed is brought to the recording region 907 by the rotation of the drum 900, a pulse voltage is applied from a voltage supply 915 to a corresponding character selection electrode to print the character on the surface of the recording medium 300. Since all characters to be printed are mounted on the periphery of the recording electrode drum 900, when it completes one revolution the printing of one line will be completed. Application of the voltage upon the selection electrode drum 901 is made by brushes 912 arranged in a gap 913 between the selection electrode drum 901 and the magnet roller 903 to contact the selection electrodes, and the leads 914 contained in the gap 913 and connected to these brushes are led out through the side surface of the selection electrode drum 901. When the recording medium 300 comprises two separable two sheets, it is possible to obtain two records at the same time after fixing.

Figure 11:
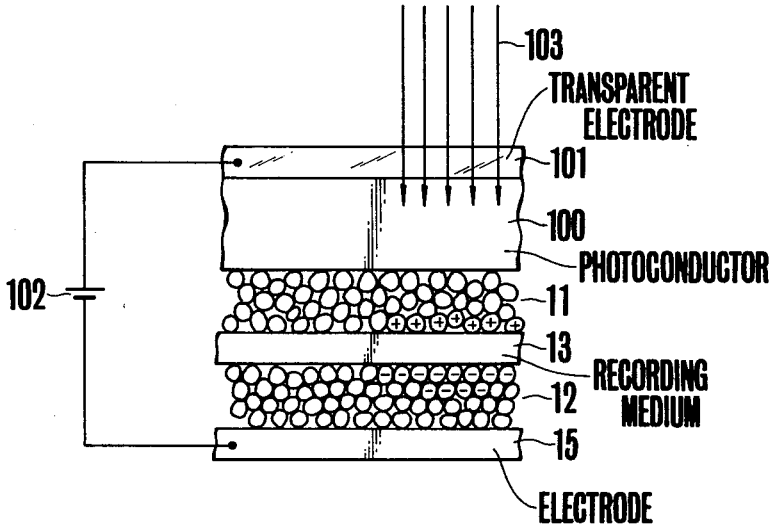
FIG. 11 is a diagrammatic representation showing the control of the deposition of toner on a photoconductor by the projection of a light image.

Although in the foregoing embodiments, the signal voltage was selectively applied to charge the electroconductive toner, such charging can also be made by projecting a light image upon a photoconductor as shown in FIG. 11.

More particularly, the embodiment shown in FIG. 11 comprises a photoconductor layer 100 and a transparent electrode 101. Reference characters 11, 12, 13 and 15 designate the same elements as in FIG. 1.

In this embodiment, a light image is projected while an operating voltage from a DC voltage supply 102, preferably a train of pulse voltages of the same amplitude, is being applied across the transparent electrode 101 and a counter electrode 15. At portions of the photoconductor 100 irradiated by the light image 103, the resistance decreases so that the electroconductive toner 11, and the electroconductive powder 12 will be charged to a high potential in the same manner as in FIG. 1, i.e. a toner image will be formed corresponding to the light image.

Some examples of the invention are illustrated as follows.

EXAMPLE 1

A plain paper having a thickness of 50 microns and a resistivity of 10" ohm-cm was fed at a speed of 10mm/sec. and layers of an electroconductive toner having the characteristic shown in FIG. 2 and a thickness of 0.1mm, each, were formed on both sides of the paper. A pulse voltage having a magnitude of 200 volts and a width of 5 milliseconds was applied across the toner layer to obtain a visible image.

EXAMPLE 2

In example 1, the electroconductive toner not in contact with the recording electrode (corresponding to the electroconductive powder 12 shown in FIG. 1) was substituted by a toner having a lower resistivity and clearer and higher density visible images are obtained than in Example 1. The amount of toner having lower resistivity deposited on the paper was smaller than Example 1.

EXAMPLE 3

A polyester film having a thickness of 25 microns was used as the recording medium and a toner layer having a thickness of 0.1 mm was formed between the recording medium and the recording electrode. Aqueduct water was interposed between the opposite surface of the recording medium and the counter electrode and a pulse voltage having a magnitude of 200 volts and a width of 5ms was applied across the opposing electrodes, thus obtaining a visible image.

As above described, according to this invention, instead of using electric discharge in air the electroconductive toner is charged by a signal voltage impressed across a pair of electrodes to form a visible image, so that it is possible to form a permanent record on inexpensive plain paper with a relatively low voltage. Further, at substantially the same time when the signal voltage is applied, it is possible to know the content of the picture information. When the invention is applied to facsimile equipment and printers it is possible to use a low recording voltage and inexpensive plain paper.

While the invention has been described in terms of some preferred embodiments, it will be clear that many changes and modifications will be obvious to one skilled in the art without departing from the scope of the invention as defined in the appended claims.

What is claimed is:

1. An electrographic apparatus comprising a pair of opposed electrodes which are spaced from each other to define a recording region therebetween, means for applying a relatively low signal voltage across said pair of electrodes, means for feeding a recording medium through said recording region, toner supply means for continuously supplying an electroconductive toner between one of the electrodes and one surface of said recording medium, means for continuously supplying electroconductive powder particles between the other electrode and the other surface of said recording medium, means for removing surplus toner and electroconductive material from the surfaces of said recording medium after it has passed through said recording region thereby forming a toner image, and means for fixing said toner image.

2. The electrographic apparatus according to claim 1 wherein said electroconductive powder particles include a magnetic powder component.

3. The electrographic apparatus according to claim 2 wherein said toner supply means is provided adjacent said one electrode, and said means for supplying said electroconductive powder particles comprises a container which contains said electroconductive powder particles, a magnetic brush including a magnet roller and an electroconductive sleeve concentrically surrounding said magnet roller, such that a relative rotary movement is caused between the roller and sleeve, a guide roller, and an electroconductive belt wrapped about said sleeve and said guide roller, said magnetic brush and said electroconductive belt constituting said other electrode whereby when the relative rotary movement is caused, said electroconductive powder particles contained in said container are supplied to said other surface of said recording medium.

4. The electrographic apparatus according to claim 3 wherein said magnet roller is rotary and said electroconductive sleeve is stationary.

5. The electrographic apparatus according to claim 1 wherein said electroconductive toner and said electroconductive powder particles each includes a magnetic powder.

6. The electrographic apparatus according to claim 5 wherein said toner supply means is provided adjacent said one electrode, and said means for supplying said electroconductive powder particles comprises a container for containing said electroconductive powder particles and a magnetic brush including a stationary magnet roller and an electroconductive rotary sleeve constituting said other electrode and concentrically surrounding said stationary magnet roller whereby when said electroconductive rotary sleeve rotates said electroconductive powder particles contained in said container are supplied to said other surface of said recording medium, and said electrographic apparatus further comprises a toner recovery device positioned adjacent said one electrode and said one surface of said recording medium, said toner recovery device including a stationary magnet roller, a rotary sleeve concentrically surrounding said magnet roller, and means in contact with the periphery of said rotary sleeve for removing said toner from said rotary sleeve and returning toner to said toner supply means whereby as the rotary sleeve of said toner recovery device rotates surplus toner on said one surface of said recording medium is removed and returned to said toner supply means.

7. The electrographic apparatus according to claim 5 wherein said toner supply means comprises a first container for containing said toner and a first magnetic brush positioned adjacent said container, said first magnetic brush including a rotary magnet roller, and a stationary sleeve concentrically surrounding said magnet roller, whereby when said rotary magnet roller rotates, said toner in said first container is supplied to said one surface of said recording medium around the periphery of said stationary sleeve, said one electrode is mounted on said stationary sleeve, and said means for supplying said electroconductive powder particles comprises a second container which contains said electroconductive powder particles, a second magnetic brush including a stationary magnet roller, and an electroconductive rotary sleeve concentrically surrounding said stationary magnet roller, and an electroconductive belt passing about said rotary sleeve, said second magnetic brush and said electroconductive belt constituting said other electrode whereby when said rotary sleeve of second magnetic brush sleeve rotates said electroconductive powder particles contained in said second container are supplied to said other surface of said recording medium.

8. The electrographic apparatus according to claim 5 wherein said toner supply means comprises a first container for containing said toner and a first magnetic brush positioned adjacent said container, said first magnetic brush including a rotary magnet roller and a stationary sleeve concentrically surrounding said magnet roller, whereby when said rotary magnet roller rotates, said toner in said first container is supplied to said one surface of said recording medium around the periphery of said stationary sleeve, said one electrode is mounted on said stationary sleeve, and said means for supplying said electroconductive powder particles comprises a second container for containing said electroconductive powder particles and a second magnetic brush including an electroconductive sleeve, constituting said other electrode, and a magnet roller concentrically contained in said sleeve such that a relative rotary movement is caused between the roller and sleeve, whereby when the relative rotary movement is caused, said electroconductive powder particles contained in said second container are supplied to the other surface of said recording medium.

9. The electrographic apparatus according to claim 8 wherein said magnet roller of the second magnetic brush is stationary and said electroconductive sleeve thereof is rotary.

10. The electrographic apparatus according to claim 8 wherein said magnet roller of the second magnetic brush is rotary and said electroconductive sleeve thereof is stationary.

11. An electrographic printing apparatus comprising a recording electrode drum including a first rotary insulating cylinder and a plurality of character electrodes embedded in the periphery of said cylinder, a stationary magnet roller concentrically contained in said recording electrode drum, a selection electrode drum oppositely disposed with respect to said recording electrode drum to define a recording region therebetween said selection electrode drum including a second rotary insulating cylinder and a plurality of selection electrodes embedded in the periphery of said second rotary insulating cylinder, a second stationary magnet roller concentrically contained in said selection electrode drum, means for feeding recording medium through said recording region, means for supplying electroconductive and magnetic toner between said recording electrode drum and one surface of said recording medium, means for supplying electroconductive and magnetic powder particles between said selection electrode drum and the other surface of said recording medium, and means for applying a relatively low operating voltage across said character electrode and said selection electrode.

12. The electrographic apparatus according to claim 1 wherein at least one of said toner and said electroconductive powder particles is colored.

13. An electrographic recording process comprising the steps of passing a recording medium through a recording region between a pair of opposing electrodes one of which is transparent and provided with a photoconductive layer on one surface, supplying an electroconductive toner between one surface of the recording medium and the transparent electrode, supplying electroconductive powder particles between the other surface of said recording medium and the other electrode, applying a relatively low DC voltage across the pair of electrodes to charge said toner and said powder particles with charges of opposite polarity, projecting a light image on the photoconductive layer through the transparent electrode to decrease the internal resistance of the photoconductive layer in accordance with the light image thereby selectively discharging said charged toner and charged electroconductive powder particles on the opposite surfaces of said recording medium, and removing surplus toner from said one surface of said recording medium thereby forming a toner image.

14. An electrographic recording process comprising the steps of passing a recording medium through a recording region between a pair of opposing electrodes, supplying an electroconductive and magnetic toner between one surface of the recording medium and one of the electrodes, supplying electroconductive liquid between the other surface of said recording medium and the other electrode, selectively applying a relatively low signal voltage across said toner, said recording medium and said electroconductive liquid through said electrodes to selectively charge said toner and said electroconductive liquid with charges of opposite polarity so that charged toner is selectively deposited on the one surface of said recording medium, and removing surplus toner from said one surface of said recording medium thereby forming a toner image.

15. The process according to claim 14 wherein said electroconductive liquid comprises alcohol.

* * * * *